US006626511B2

(12) United States Patent
Riou

(10) Patent No.: US 6,626,511 B2
(45) Date of Patent: Sep. 30, 2003

(54) ADJUSTABLE CHASSIS FOR AUTOMATED WRITING INSTRUMENT CARRIAGE

(75) Inventor: Michel Anthony Riou, Milwaukie, OR (US)

(73) Assignee: Hewlett Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/080,328

(22) Filed: Feb. 21, 2002

(65) Prior Publication Data

US 2002/0089556 A1 Jul. 11, 2002

Related U.S. Application Data

(63) Continuation of application No. 09/479,516, filed on Jan. 7, 2000, now Pat. No. 6,382,752.

(51) Int. Cl.[7] ..... B41J 25/308; B41J 23/00

(52) U.S. Cl. ..... 347/8; 347/37

(58) Field of Search ..... 347/8, 37, 160, 347/149; 346/139 R; 400/55, 56, 120.16, 120.17

(56) References Cited

U.S. PATENT DOCUMENTS

| | | | | | |
|---|---|---|---|---|---|
| 4,570,168 | A | * | 2/1986 | Sjordal et al. | 400/55 |
| 4,921,365 | A | * | 5/1990 | Sanders, Jr. et al. | 400/322 |
| 4,929,102 | A | * | 5/1990 | Mizutani et al. | 400/56 |
| 5,103,731 | A | * | 4/1992 | Williams et al. | 347/160 |
| 5,806,992 | A | * | 9/1998 | Ju | 347/8 |
| 6,095,701 | A | * | 8/2000 | Sattler | 400/120.17 |
| 6,382,752 | B1 | * | 5/2002 | Riou | 347/8 |

FOREIGN PATENT DOCUMENTS

| | | | | |
|---|---|---|---|---|
| JP | 06099641 | * | 4/1994 | 347/37 |

* cited by examiner

*Primary Examiner*—Craig Hallacher
*Assistant Examiner*—Julian D. Huffman

(57) ABSTRACT

A method and apparatus for setting the writing instrument distance and orientation to an adjacent platen uses independently adjustable devices positioned such that both the gap between the writing instrument and platen and the pitch and roll angles of the printhead to the platen can be aligned to predetermined appropriate settings.

11 Claims, 8 Drawing Sheets

ADJUSTABLE CHASSIS FOR AUTOMATED WRITING INSTRUMENT CARRIAGE

CROSS REFERENCE TO RELATED APPLICATION(S)

This is a continuation of application Ser. No. 09/479,516 filed on Jan. 7, 2000, now U.S. Pat. No. 6,382,752, which is hereby incorporated by reference herein.

BACKGROUND OF THE INVENTION

1. Field of the Invention

The present invention relates generally to automated hard copy apparatus, such as ink-jet printers, and more specifically to an adjustable carriage mount for aligning an automated writing instrument, such as an ink-jet printhead, with respect to a printing zone of the apparatus.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [*sic*] *Devices,* chapter 13 (Ed. R. C. Durbeck and S. Sherr, Academic Press, San Diego, 1988).

FIG. 1 (PRIOR ART) depicts an ink-jet hard copy apparatus, in this exemplary embodiment a computer peripheral printer, 101. A housing 103 encloses the electrical and mechanical operating mechanisms of the printer 101. Operation is administrated by an electronic controller 102 (usually a microprocessor or application specific integrated circuit ("ASIC") controlled printed circuit board) connected by appropriate cabling to a computer (not shown). It is well known to program and execute imaging, printing, print media handling, control functions and logic with firmware or software instructions for conventional or general purpose microprocessors or with ASIC's. Cut-sheet print media 105, loaded by the end-user onto an input tray 120, is fed by a suitable paper-path transport mechanism (not shown) to an internal printing zone 107 where graphical images or alphanumeric text is created. A carriage 109, mounted on a carriage rod, or slider, 111, scans the print zone 107. An encoder subsystem 113, 201 is provided for keeping track of the position of the carriage 109 at any given time. A set of individual ink-jet pens, or print cartridges, $\mathbf{115}_x$ are releasably mounted in the carriage 109 and fluidically coupled, such as by flexible tubing 119, to ink reservoirs $\mathbf{117}^x$ (generally, in a full color system, inks for the subtractive primary colors, cyan, yellow, magenta (CYM) and true black (K) are provided; an ink fixer chemical (F) is also sometimes provided). Once a print job is completed, the print medium is ejected onto an output tray 121. The carriage scanning axis is conventionally designated the x-axis, the print media transit axis is designated the y-axis, and the printhead firing direction is designated the z-axis. [or convenience of describing the ink-jet technology and the present invention, all types of print media are referred to simply as "paper," all compositons of colorants are referred to simply as "ink," and all types of hard copy apparatus are referred to simply as a "printer." No limitation on the scope of invention is intended nor should any be implied.]

In essence, the ink-jet printing process involves digitized dot-matrix manipulation of drops of ink ejected from a pen onto an adjacent paper. One or more ink-jet type writing instruments (also referred to in the art as an "ink-jet pen" or "print cartridge") includes a printhead which generally consists of drop generator mechanisms and a number of y-axis aligned columns of ink drop firing nozzles of a substantially planar nozzle plate superjacent the drop generator mechanisms. Each column or selected subset of nozzles (referred to in the art as a "primitive") selectively fees ink droplets (typically each being only a few picoliters in liquid volume) that are used to create a predetermined print matrix of dots on the adjacently positioned paper as the pen is scanned across the media. A given nozzle of the printhead is used to address a given matrix column print position on the paper (referred to as a picture element, or "pixel"). Horizontal positions, matrix pixel rows, on the paper are addressed by repeatedly firing a given nozzle at matrix row print positions as the pen is scanned. Thus, a single sweep scan of the pen across the paper can print a swath of tens of thousands of dots. The paper is stepped to permit a series of contiguous swaths. Complex digital dot matrix manipulation is used to form alphanumeric characters, graphical images, and photographic reproductions from the ink drops. Page-wide ink-jet printheads are also contemplated and are adaptable to the present invention. Thus, it can be recognized that a critical operating factor is printhead-to-paper spacing and alignment to ensure aerate dot placement.

FIG. 2 (Prior Art) schematically illustrates a typical pen-to-paper alignment scheme. The front of the carriage 109 (with respect to the leading edge of a sheet of paper 105 in the print zone 107 supported by a platen or suspended by a paper pivot apparatus (neither shown)) is used as a pivot point "A" and known manner camming mechanisms (not shown) are provided on at least one end of the slider 111. Note that mechanical tolerances inherent in such rod adjustment mechanisms can be the source of vibration of the rod and hence the carriage and pens. Letting "Theta-X" represent the pitch angle of the printhead 201 with respect to a Y-plane, it can be recognized that Theta-X is not held when adjusting the slider up or down (as represented by the arrows Z-up and Z-down) with the carriage 109 pivoting about point "A." Therefore, another adjustment mechanism would be required to ensure pitch axis parallelism between the printhead 201 and the paper 105. It can also now be recognized that other degrees of freedom of the printhead 201 must be accounted for; let "Theta-Y" represent the roll angle of the printhead with respect to an X-plane, and let "Theta-Z" represent the yaw angle of the printhead nozzle columns with respect to the Y-axis. When both Theta-Z=0° and Theta-X=0°, the long axis—that is, the columns of nozzles—of the printhead 201 is parallel to the paper transport Y-axis; when Theta-Y=0°, the short axis of the printhead—that is, a line perpendicular to the columns of nozzles—is parallel to the carriage scanning X-axis.

There is a need for an adjustable carriage mount which will provide independent carriage alignment.

SUMMARY OF THE INVENTION

In its basic aspects, the present invention provides a system for aligning a writing instrument to a print medium, including: a support base having a substantially fixed position; a chassis for retaining the writing instrument; and a plurality of support mechanisms for coupling the chassis to the base, each of the support mechanisms having alignment mechanisms for independently adjusting spacing between the chassis and the base wherein pitch angle and roll angle of the writing instrument with respect to the print medium is determined by adjusting each of the support mechanisms.

In another basic aspect, the present invention provides an ink-jet hard copy apparatus, including: a base having a substantially fixed spatial orientation; a print zone having a substantially fixed spatial orientation with respect to the base; a chassis for retaining at least one ink-jet printhead device in a predetermined orientation the print zone; and a plurality of supports for coupling the chassis to the base, each of the supports being fixedly mounted to the base and each of the supports having a range of settable distance positions wherein setting the distance between the printhead device and the print zone simultaneously adjusts the printhead device pitch and roll angle with respect to the print zone.

In another basic aspect, the present invention provides a method for adjusting the spatial orientation of an ink-jet printhead to a printing zone of an ink-jet hard copy apparatus. The method includes the steps of: providing at least three independently adjustable printhead mounts for setting the distance between the printhead and the printing zone; and independently adjusting the printhead mounts to set the pitch angle and roll angle of the printhead to predetermined settings.

The method and apparatus can be automated by providing known manner sensing mechanisms for detecting real-time orientation of the printhead to the printing zone and providing signals indicative of the orientation, and automatically adjusting the printhead mounts based on the signals such that a predetermined orientation of the printhead is maintained with respect to the printing zone.

Some of the advantage of the present invention are:

it solves problems attendant to the prior art;

it provides a simple mechanism for adjusting pen-to-paper alignment whereby a printhead can be aligned to be parallel to adjacently positioned print media;

it provides for pen-to-paper height and both Theta-X and Theta-Y adjustment;

it frees the carriage rod in a scanning ink-jet device from mechanisms for adjusting pen-to-paper height, wherein the carriage rod can have better mechanical tolerances and integrity;

it substantially eliminates print quality problems induced by an adjustable, vibrating carriage rod; and it is adaptable to a fully automated implementation.

The foregoing summary and list of advantages is not intended by the inventor to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

BRIEF DESCRIPTION OF THE DRAWINGS

FIGS. 3 and 3A are two views of a pen carriage and associated mounting subsystem in accordance with the present invention for a hard copy apparatus, in which:

FIG. 3 is a top view of a base plate, a carriage chassis with a carriage on a slider bar, and FIG. 3A is a perspective view of the carriage chassis with a pen carriage on a slider bar as shown in FIG. 3 but with the base plate deleted.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventor for practicing the invention. Alternative embodiments are also briefly described as applicable.

It will be recognized by those skilled in the art that the present invention is used in conjunction with precision tools, such as laser alignment tools, for setting ink-jet alignment with respect to the hard copy apparatus printing zone. Usually this is a manufacturing process. However, it is expressly intended that the present invention can be automated for real-time printing operation as will be explained in detail hereinafter. Further explanation of the details of such state-of-the-art alignment tools is not necessary for a complete understanding of the present invention.

Figure 1:
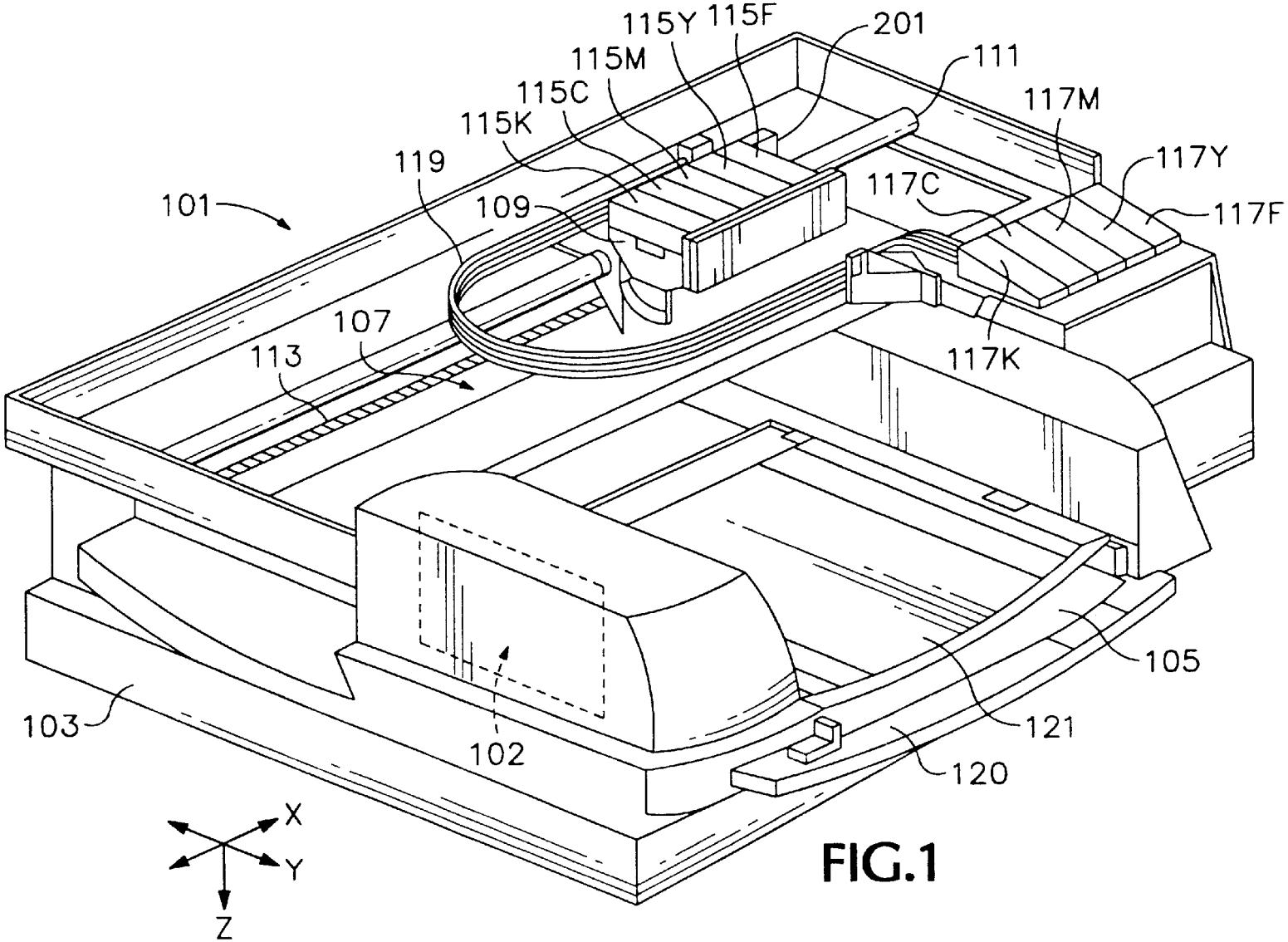
FIG. 1 (Prior Art) is an exemplary ink-jet hard copy apparatus in which the present invention may be employed.
Figure 2:
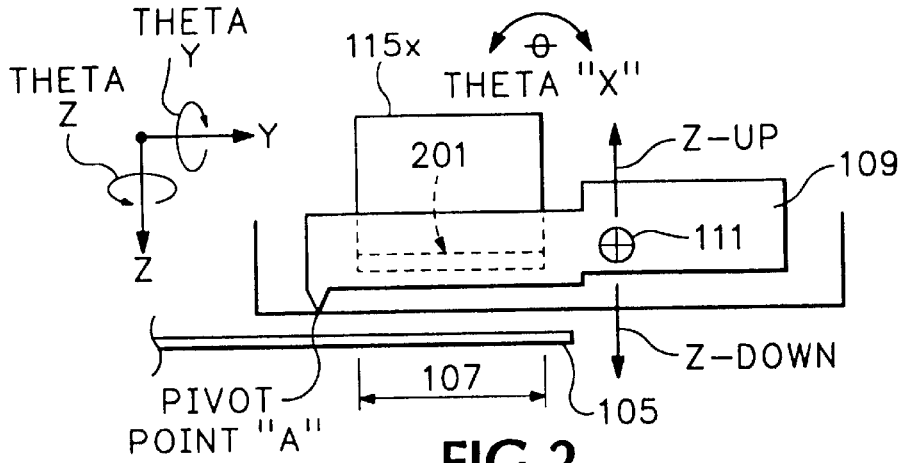
FIG.2 (PRIOR ART)
FIG. 2 (Prior Art) is a schematic illustration of a typical pen carriage mount used in a scanning ink-jet hard copy apparatus.
Figure 3A:
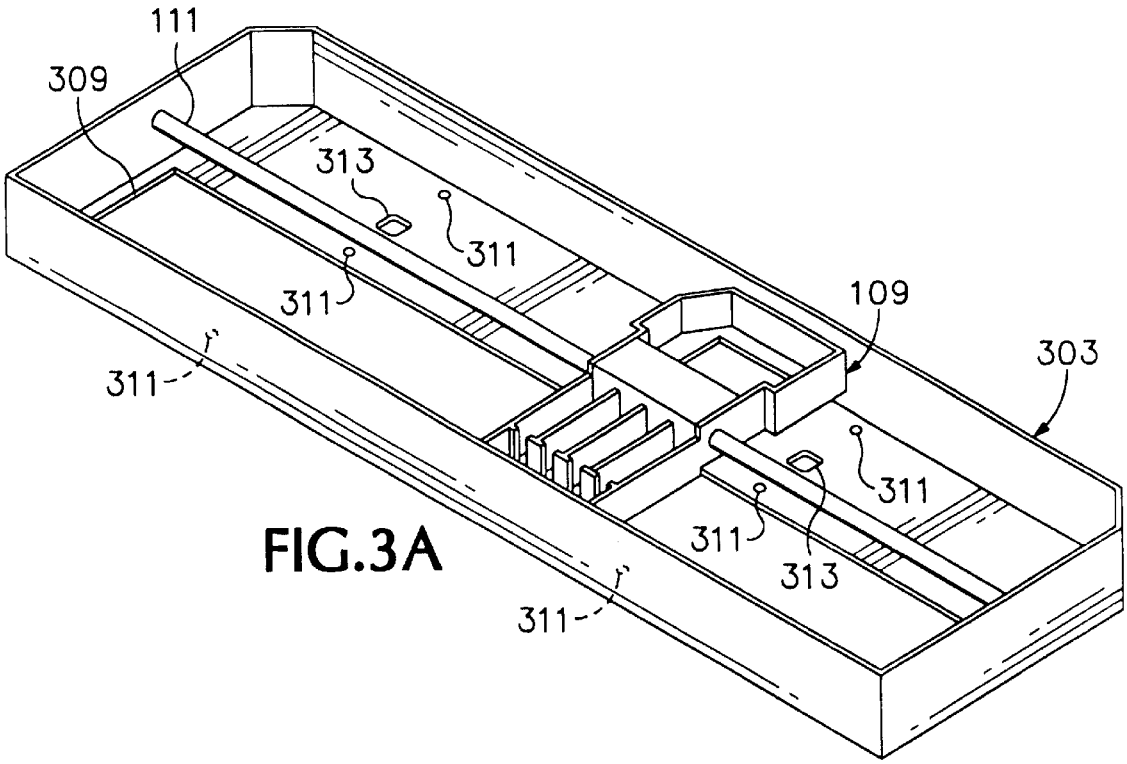
Figure 3:
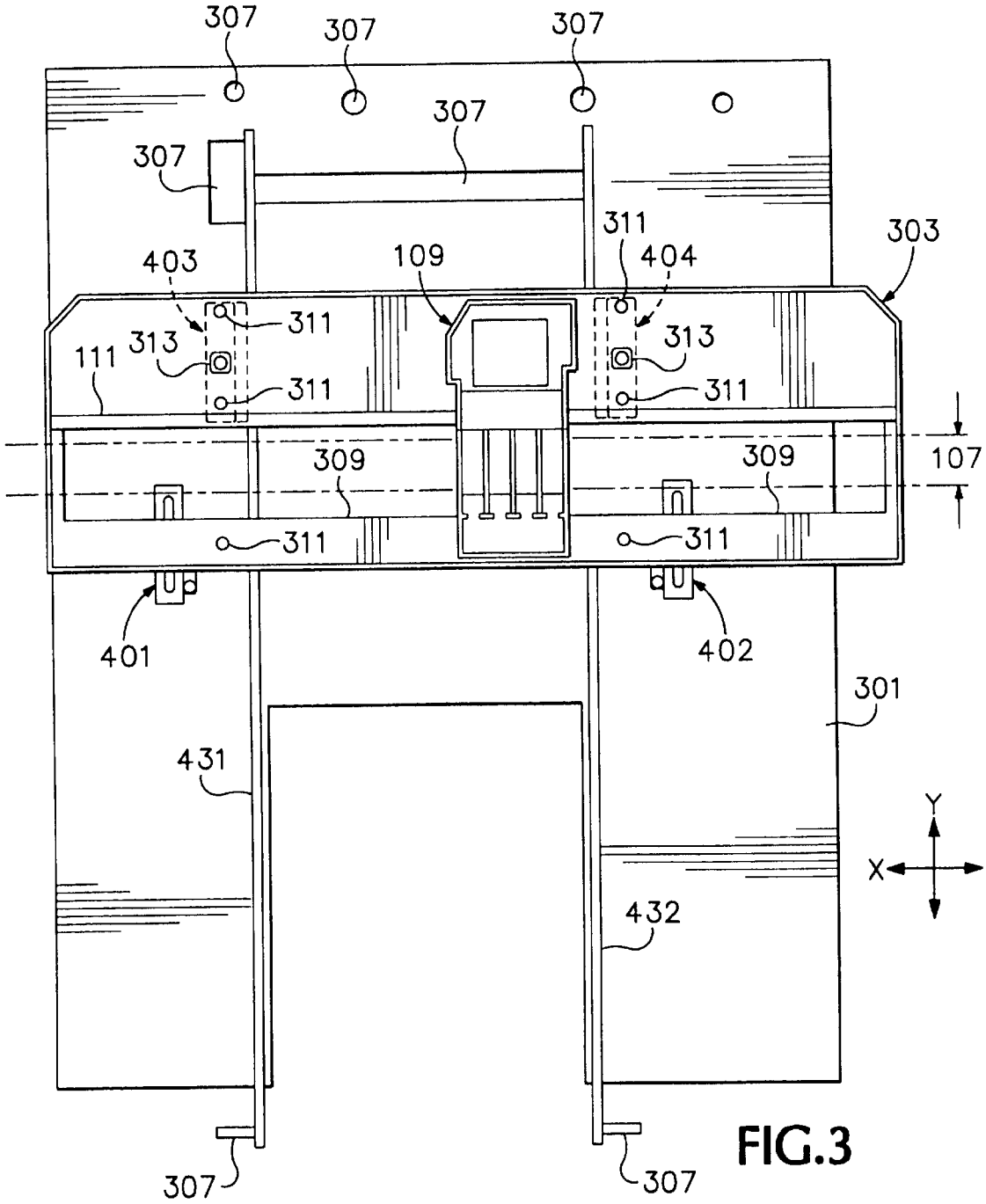

FIG. 3 is an overhead, planar view, of an exemplary embodiment in accordance with the present invention of a base 301, a pen carriage chassis 303 and the pen carriage 109 atop the slider 111, as shown in FIG. 1. A perspective view of this embodiment is shown in FIG. 3A, with the base 301 removed. It will be recognized by those skilled in the art that the details of these components will vary from implementation to implementation.

The base 301 forms a structural foundation for the housing 103 and contained subsystems of the printer 101, with an emphasis on reducing vibration and noise. Known manner base-to-housing mounting features 307 are provided as needed to suit a specific design.

The carriage chassis 303 is used as a substantially rigid mount for the slider 111 and the carriage 109. It includes an aperture 309 such that the pens $\mathbf{115}_x$ have respective printheads aligned and open to the print zone 107 of the printer 101. Otherwise its construction details again can be expedient to a specific implementation. Critical to the present invention is the mounting construct used between the base 301 and the pen carriage chassis 303.

Figure 4:
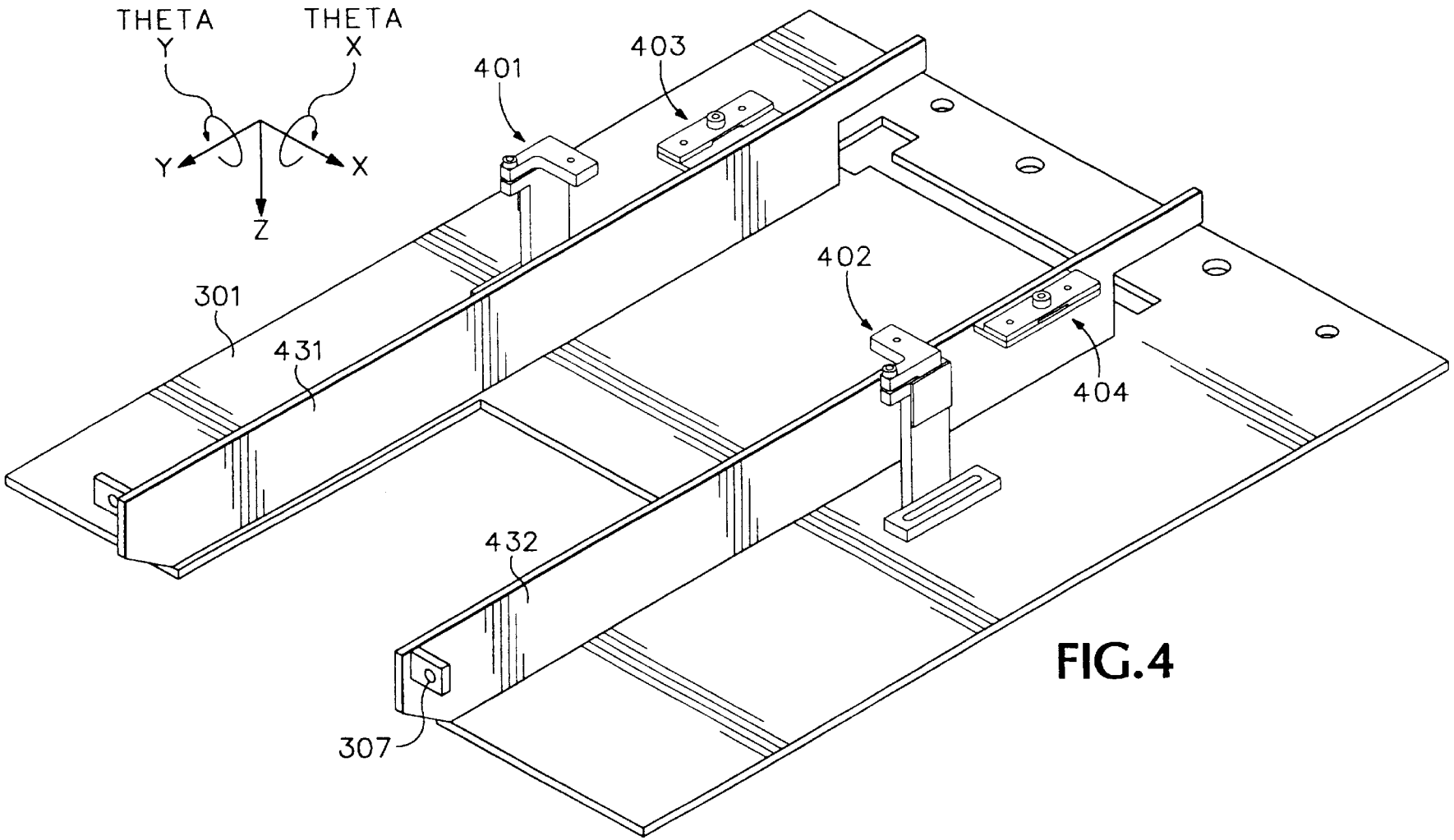
FIG. 4 is a perspective drawing of the base plate of FIG. 3 with carriage chassis mount subassemblies of the present invention positioned thereon.
Figure 5A:
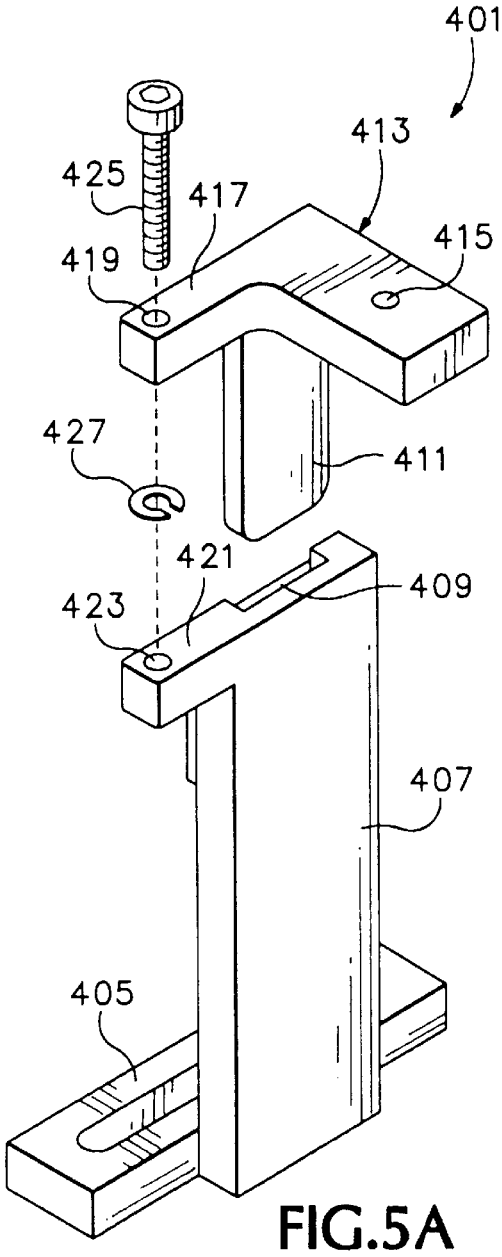
FIGS. 5A and 5B are exploded, perspective drawings of one of the base-to-chassis mounts in accordance with the present invention.
Figure 5B:
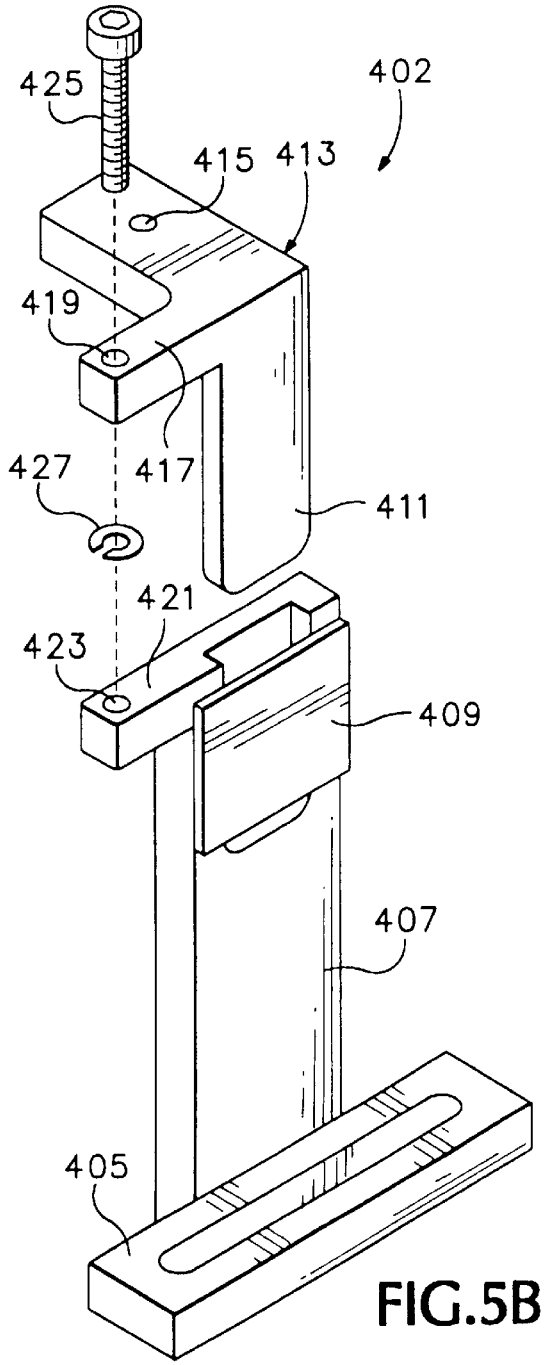
Figure 5C:
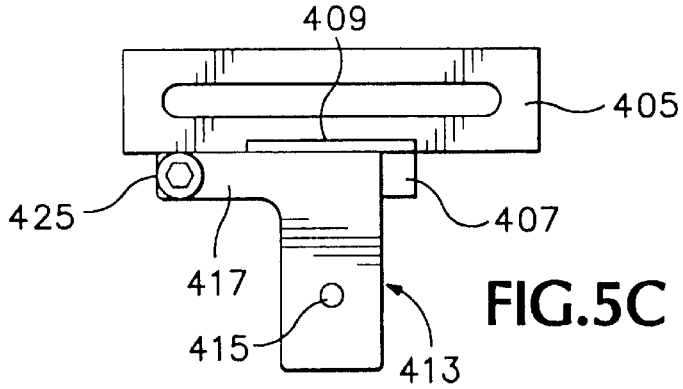
FIGS. 5C, 5D, and 5E are orthogonal projection drawings of the base-to-chassis mount as shown in FIG. 5B.
Figure 5D:
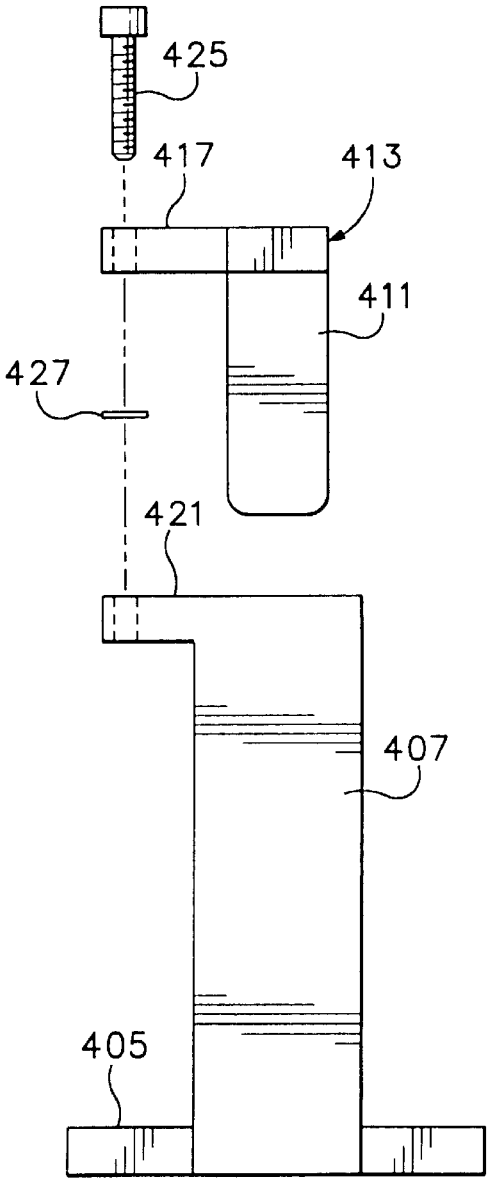
Figure 5E:
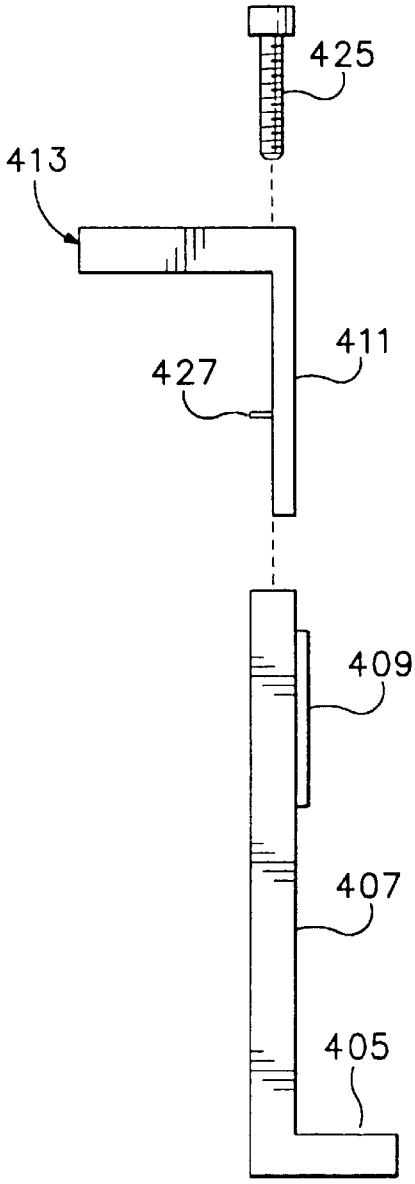

In FIG. 4, the chassis 303, slider 111, and pen carriage 109 subassemblies have been deleted to expose preferred embodiments of four adjustable chassis mounting supports 401, 402, 403, 404, as located on the base 301 (see also notation on FIG. 3. Preferably, the supports 401–404 are located in both the relative front and rear of the assembly and at suitable spacing—generally as far apart as feasible for a specific implementation—to allow the greatest available adjustment resolution while still maintaining structural integrity and rendering the chassis 303 substantially impervious to vibrations (such mechanical leverage techniques are well known to persons of average skill in the art).

These front and rear chassis adjustable mounting supports 401–404 are detailed in FIGS. 5A–5E, 6 and 6A–6C. [As is known in the art, there are a variety of ways to implement hard copy printing apparatus. Therefore, terms like, "front," "rear," "top," and the like, are relative to a specific design. No limitation on the scope of the invention is intended by the inventor nor should any be implied.]

As best seen in FIGS. 5A–5E, the front supports 401, 402 are mirror image constructs; a description of one relates to both. A slotted flange 405 provides for the front support 401 to be rigidly attached by any known manner fastener to the base 301. A stanchion 407 rising from the flange 405 includes a groove bearing 409 for receiving a descending tongue 411 of a chassis mount slider 413. The slider 413 is affixed to the chassis 303 in a known manner such as with a machine bolt (not shown) via an attachment hole 415. The slider 413 has a protruding arm 417 incorporating a clearance hole 419. A matching arm 421 on the stanchion 407 has a tapped hole 423 aligned to the slider arm clearance hole 419. A threaded adjustment screw 425 and retainer clip 427 are provided such that turning the adjustment screw causes the slider 413 to ride up-and-down on the stanchion 407 via the tongue 411 and groove bearing 409.

Figure 6:
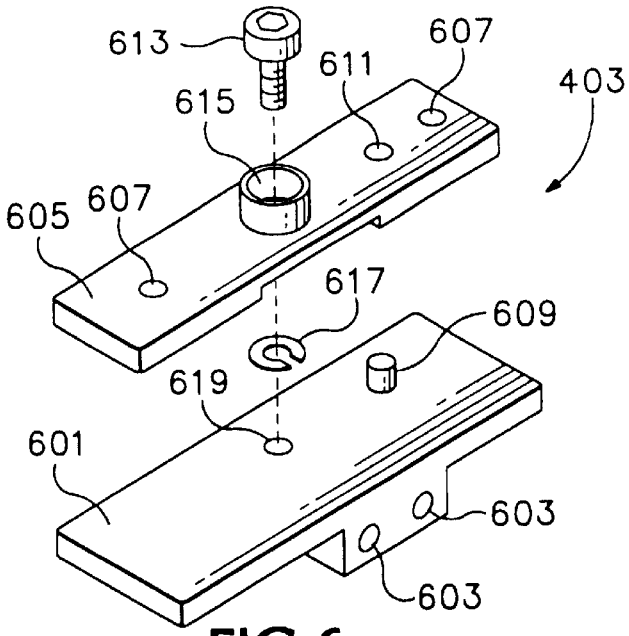
FIG. 6 is an exploded, perspective drawing of another one of the base-to-chassis mounts in accordance with the present invention.
Figure 6A:
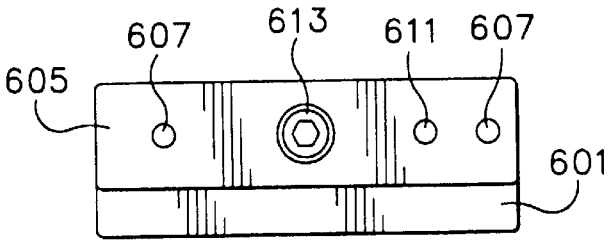
FIGS. 6A, 6B and 6C are orthogonal projection drawings of the base-to-chassis mount as shown in FIG. 6.
Figure 6B:
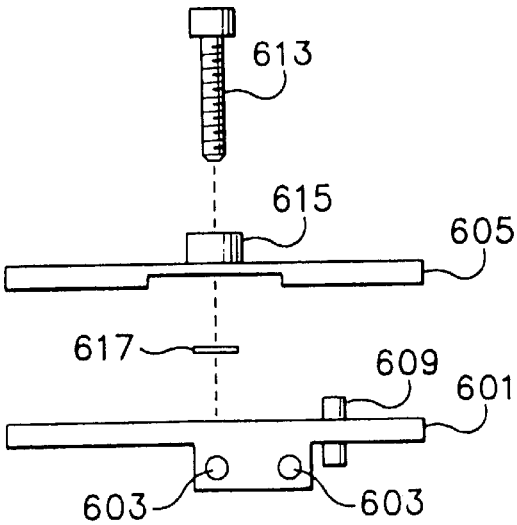
Figure 6C:
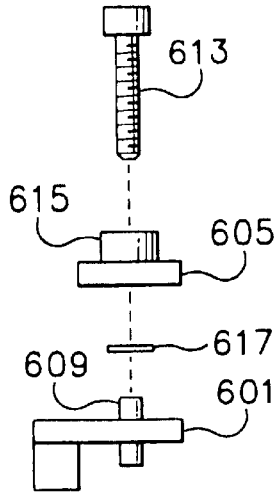

FIG. 6 is a perspective view of a pen carriage chassis rear support 403/404. FIGS. 6A–6C show planar orthogonal projections of the rear support device. As best seen in FIG. 4, the rear supports 403, 404 are two-piece constructs with a bottom piece 601 fixedly attached—such as by screws or bolts (not shown) using fastener holes 603, or any other known manner—to uprights 431, 432 rising from the base plate 301. Returning to FIGS. 6 and 6A—6C, a top piece 605 is fixedly attached to the chassis 303—such as by screws or bolts (not shown) using fastener holes 607, or any other known manner. The rear support top piece 605 and bottom piece 601 are aligned via a guide pin 609 and a socket 611 and a separately aligned set screw 613, sleeved socket 615, retainer clip 617 and threaded hole 619. As shown in FIG. 3A, the pen carriage chassis 303 is provided with appropriate apertures 311 matching the attachment hole 415 for the front supports 401, 402 and the fastener holes 607 of the rear supports 403, 404 adapted for use with appropriate fastening mechanisms chosen for any specific implementation. The design should be such that the supports 401–404 are distributed with respect to the base 301 with x-axis and y-axis displacement such that the chassis 303 is substantially impervious to vibrations transmitted by motion of the carriage 109. If necessary, an access port 313 through the chassis 303 is provided for inserting an appropriate adjustment tool into the set screw 613.

Figure 7A:
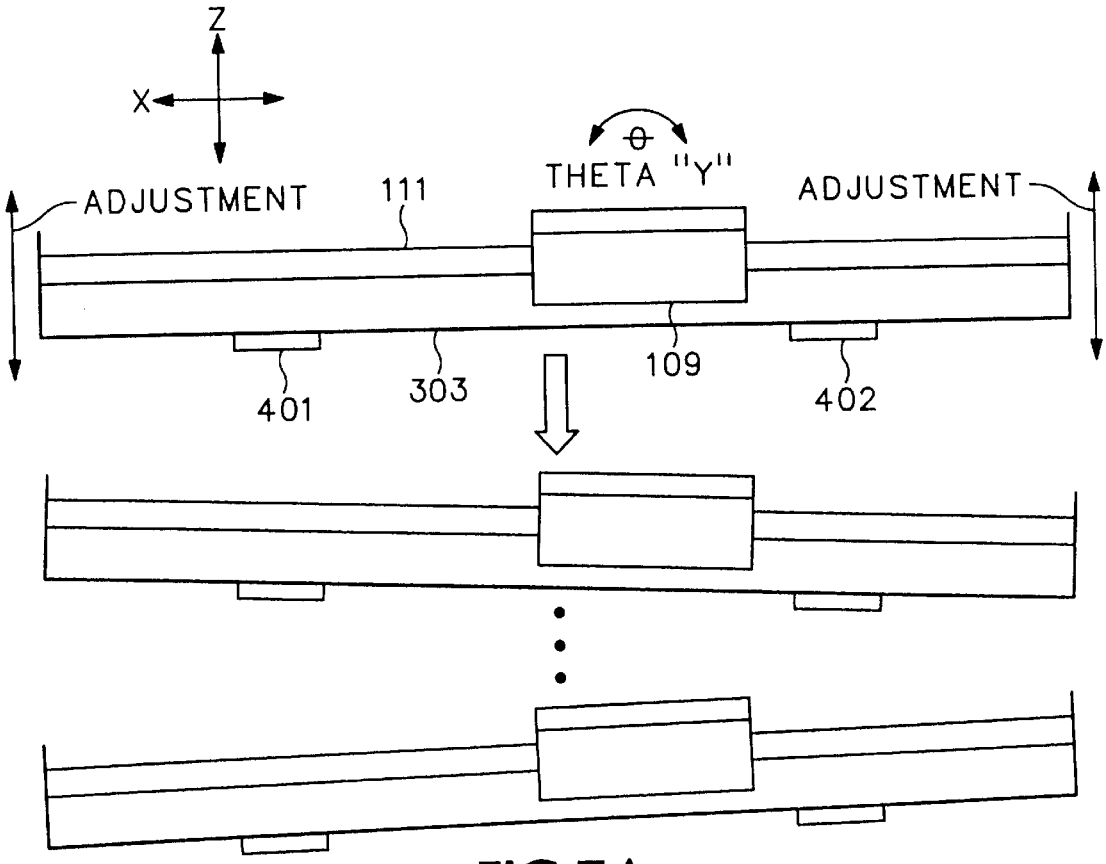
FIGS. 7A and 7B demonstrate the operation of the present invention as shown in FIG. 3.
Figure 7B:
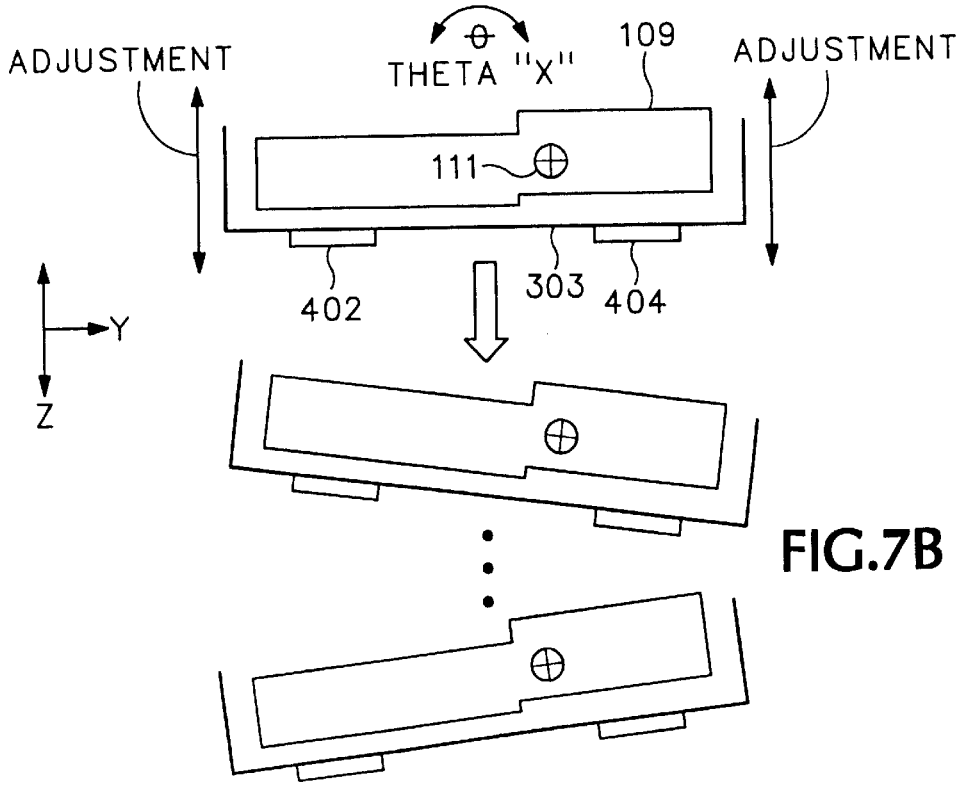

The operation of the ink-jet pen carriage chassis mounts is schematically depicted in FIGS. 7A and 7B, greatly exaggerating possible adjustment position extremes to demonstrate the nature of the invention. All four supports 401–404 are used to set the z-axis, printhead(s)-to-paper distance. Theta-X, printhead pitch, and Theta-Y, printhead roll, adjustments are then fine tuned using the set screws 425, 613 of the front and rear supports 401–404. The pitch of the threads of each set screw 425, 613 and its respective associated threaded hole in the supports 423, 601 determine the degree of adjustment sensitivity. While four supports 401–404 are demonstrated, it will be recognized by those skilled in the art that other implementations can be designed in accordance with the specific implementation.

Thus, the present invention provides an ink-jet pen (or other writing instrument where printing head design and angle of alignment to the print media is critical to print quality) carriage chassis having independent supports that are individually adjustable in the pen-to-paper axis such that by adjusting each support independently, pitch and roll of the pen are also adjusted. It will be further recognized by those skilled in the art that the present invention can be employed with platen subsystems having an orientation other than horizontal as shown in the exemplary embodiments used to for this Detailed Description. It should also be noted that the alignment system described can also be adapted to a non-scanning, page-wide, printhead design ink-jet apparatus. While the adjusters have been demonstrated as supports, independently adjustable suspension type mechanisms should be considered as equivalents. Moreover, it should also be recognized that mounting the orientation adjusters to other fixed paper support subsystems, such as a vacuum box for a vacuum belt type hard copy apparatus and the like, should be considered as equivalent to having a base plate mounting.

As mentioned above, usually the alignment of an automated writing instrument to a print zone is a post-assembly, manufacturing process. However, it can now be recognized that in a hard copy apparatus requiring the ability to repeatedly provided extremely detailed prints—e.g., semiconductor mask prints, complex wiring diagrams, architect illustrations, and the like—the present invention could be automated. Alignment detectors—such as known optical or magnetic sensing devices—can be mounted on the carriage, the chassis, or to the base for providing signals indicative of current writing instrument to print zone alignment. The set screws 425, 613, or other known manner alignment tuning devices, can be driven by motors controlled in accordance with real-time alignment information based on the signals from the detectors. While such an automated alignment subsystem would add substantial manufacturing cost to the hard copy apparatus, the reduction in need for maintenance or servicing could be shown to be offset. Note that such a system can also be tuned to a very fine degree with precision adjustment parts and alignment detectors to reposition the printhead automatically to different thickness of print media.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . ".

What is claimed is:

1. A method for adjusting the spatial orientation of an inkjet printhead to a printing zone of an inkjet hard copy apparatus, the method comprising:

providing at least three independently adjustable printhead mounts coupling a chassis, carrying a carriage retaining the printhead therein, to a fixed base for setting the distance between the printhead and the printing zone; and independently adjusting the printhead mounts to set the pitch angle and roll angle of the printhead to predetermined settings.

2. The method as set forth in claim 1, the method comprising:

providing known manner sensing means for detecting real-time orientation of the printhead to the printing zone and providing signals indicative of the orientation, and adjusting the printhead mounts based on the signals such that a predetermined orientation of the printhead is maintained with respect to the printing zone.

3. The method as set forth in claim 1, the adjusting comprising:

adjusting spacing between the chassis and the base.

4. The method as set forth in claim 1, further comprising:

providing said mounts with a first member fixedly attached to the base and a second member fixedly attached to the chassis.

5. The method as set forth in claim 4, further comprising:

said adjusting includes changing a span between the first member and the second member.

6. The method as set forth in claim 1, the providing at least three independently adjustable printhead mounts further comprising:

mounting the mounts to the base with respect to the base with relative x-axis and y-axis displacement such that the chassis is substantially impervious to vibrations transmitted by motion of the printhead.

7. A method for aligning an inkjet printhead to print media, the method comprising:

mounting a printhead carriage to a chassis;

fixedly mounting the printhead in the carriage;

mounting the chassis to a fixed base using at least three adjustable supports; and adjusting each of the supports.

8. The method as set forth in claim 7, said adjusting comprising:

independently adjusting spacing between the chassis and the base.

9. The method as set forth in claim 8 wherein pitch angle and roll angle of the printhead with respect to the print media is determined by said adjusting.

10. The method as set forth in claim 7 comprising:

mounting support members of the supports to the base with respect to the base with relative x-axis and y-axis displacement such that the chassis is substantially impervious to vibrations transmitted by motion of the carriage.

11. The method as set forth in claim 7 further comprising:

providing sensing means for detecting real-time orientation of the printhead to the printing zone and providing signals indicative of the orientation, and providing said adjusting based on the signals such that a predetermined orientation of the printhead is maintained with respect to the media.

* * * * *